United States Patent [19]

Baird, Jr. et al.

[11] 4,087,348

[45] May 2, 1978

[54] DESULFURIZATION AND HYDROCONVERSION OF RESIDUA WITH ALKALINE EARTH METAL COMPOUNDS AND HYDROGEN

[75] Inventors: William C. Baird, Jr.; Roby Bearden, Jr., both of Baton Rouge, La.

[73] Assignee: Exxon Research & Engineering Co., Linden, N.J.

[21] Appl. No.: 733,085

[22] Filed: Oct. 18, 1976

Related U.S. Application Data

[63] Continuation-in-part of Ser. No. 571,904, Jun. 2, 1975, abandoned.

[51] Int. Cl.[2] ..... C10G 13/04; B01J 27/04

[52] U.S. Cl. ..... 208/108; 208/112; 208/213; 208/214; 208/226; 252/439; 252/475

[58] Field of Search ..... 208/112, 230, 213–214, 208/226–229, 108–110

[56] References Cited

U.S. PATENT DOCUMENTS

| | | | |
|---|---|---|---|
| 1,845,439 | 2/1932 | Pier et al. | 208/112 |
| 1,968,208 | 7/1934 | Hugel et al. | 208/108 |
| 2,886,513 | 5/1959 | Baker | 208/121 |
| 3,663,433 | 5/1972 | Fraini et al. | 208/213 |
| 3,715,303 | 2/1973 | Wennerberg et al. | 208/112 |
| 3,787,315 | 1/1974 | Bearden et al. | 208/208 M |
| 3,846,287 | 11/1974 | Jaffe et al. | 208/216 |

*Primary Examiner*—Delbert E. Gantz
*Assistant Examiner*—G. E. Schmitkons
*Attorney, Agent, or Firm*—Edward M. Corcoran

[57] ABSTRACT

Sulfur-containing petroleum oil feedstocks which include heavy hydrocarbon constituents undergo simultaneous desulfurization and hydroconversion by contacting such feedstocks with alkaline earth metal hydrides or alkaline earth metal oxides, particularly barium hydride or barium oxide, in the presence of hydrogen, and at elevated temperatures. The mixtures of reaction products resulting from the above procedure can be separated to give a petroleum oil product which has been substantially desulfurized and demetallized and significantly upgraded as demonstrated by reduced Conradson carbon content, and increased API gravity and which includes alkaline earth metal sulfide salts from which the alkaline earth metal hydrides or oxides may be regenerated.

15 Claims, No Drawings

DESULFURIZATION AND HYDROCONVERSION OF RESIDUA WITH ALKALINE EARTH METAL COMPOUNDS AND HYDROGEN

CROSS-REFERENCE TO RELATED APPLICATION

This application is a continuation-in-part of application Ser. No. 571,904, filed June 2, 1975, now abandoned.

BACKGROUND OF THE INVENTION

1. Field of the Invention

This invention relates to the combined desulfurization and hydroconversion, and consequent upgrading, of sulfur-bearing hydrocarbon feedstocks by contacting the feedstock with an alkaline earth metal hydride or oxide in the presence of hydrogen and at elevated temperatures.

2. Description of the Prior Art

The problem of air pollution, particularly with regard to sulfur oxide emissions, has been of increasing concern to refiners. As a consequence, the development of efficient as well as economic means for the removal of sulfur from sulfur-bearing fuel oils has become a primary research goal in this industry. Presently, the most practical desulfurization process is the catalytic hydrogenation of sulfur-containing molecules in petroleum hydrocarbon feeds to effect the removal of these sulfur molecules as hydrogen sulfide. The process generally requires relatively high hydrogen pressures, e.g., from about 700 to 3000 psig and temperatures in the range of about 650° F to 800° F depending on the feedstock and the degree of desulfurization. Also, these processes do not effect the simultaneous desulfurization and hydroconversion of the feedstocks employed, and particularly not without a high degree of coke make during same.

The catalytic process is thus generally quite efficient in the handling of distillates, but becomes more complex and expensive and less efficient as the feedstock becomes increasingly heavier, e.g., whole or topped crudes and residua. Thus, for example, a residuum feedstock is often times contaminated with heavy metals, e.g., nickel, vanadium, iron, and asphaltenes which tend to deposit on and deactivate the catalyst. Also, the sulfur is generally contained in high molecular weight molecules that can be broken down only with the aid of severe operating conditions. Such operating conditions, however, tend to accelerate catalyst deactivation due to the accelerated depositions of coke and metal on the catalyst surfaces.

It has also long been known that alkali and alkaline earth metals, as well as their corresponding hydrides, hydroxides and oxides, exhibit desulfurization activity for residua, but even so suffer from distinct drawbacks, such as poor desulfurization efficiency, a tendency to produce oil insoluble sludges, the inability to upgrade the feedstock by demetallization, and the formation of salt-oil mixtures that are exceedingly difficult to resolve by conventional means. Furthermore, again, none of these materials has ever been employed to obtain the simultaneous desulfurization and substantial hydroconversion of the feedstocks being treated.

As an example of such a prior art process, U.S. Pat. No. 1,865,235 to Cross discloses the use of sodium, calcium, potassium, magnesium, strontium, barium and lithium in their metallic form or as hydrides thereof by contacting such materials with oils to be desulfurized at relatively low temperatures. Furthermore, U.S. Pat. No. 2,002,747 to Morrell discloses a method for the desulfurization of hydrocarbon oils wherein metals of the alkali or alkaline earth groups, preferably in a molten state, together with gases such as ammonia, steam and air react with cracked hydrocarbon vapors to produce sulfides of the metals involved, hydrogen sulfide and hydrogen in a state sufficiently reactive to substantially saturate the olefinic constituents of the vapors. The above reaction is generally carried out at a temperature of the order of 750° to 1000° F, under a pressure of the order of 100 to 500 psig. U.S. Pat. No. 3,633,433 to Fraini relates to a process for reducing the sulfur content of hydrocarbon oils by reacting such feedstocks in a hydrogen atmosphere with finely divided magnesium, at a temperature in the range of 600° to 850° F under a pressure of 100 to 200 psig and employing a hydrogen flow rate of 0.5 to 1.5 moles hydrogen per mole of feedstock per hour. Once again, however, none of these processes employ the materials of the present invention in order to obtain simultaneous desulfurization and hydroconversion.

While these techniques have thus proven successful with regard to desulfurization, the search has continued for improved desulfurization processes which are capable of effecting significant simultaneous hydroconversion, and for improved methods for regenerating the products produced by the contact of the desulfurization agent in the reaction zone.

It has now been found that when alkaline earth metal hydrides, oxides and mixtures thereof, especially barium hydride and barium oxide, are contacted to react with sulfur-bearing, heavy petroleum oil feedstocks, in the presence of hydrogen, at elevated temperatures, the feedstock undergoes desulfurization and demetallization while, simultaneously, heavy constituents of the feedstock undergo hydroconversion to lighter, lower boiling components. Thus, in effect the use of alkaline earth metal hydrides or oxides in conjunction with the hydrogen as described herein results in a combined and simultaneous desulfurization and hydroconversion of the feedstock which may be effected in an efficient and economical manner. In the past it has not been known to subject such feedstocks to such hydroconversion in the presence of such materials.

SUMMARY OF THE INVENTION

In accordance with the present invention, an efficient desulfurization, hydroconversion and feed upgrading process is provided, wherein sulfur-bearing, heavy hydrocarbon feedstocks, for example whole or topped crudes and residua, and hydrogen are contacted in a reaction zone with said feedstock being substantially in the liquid phase in said reaction zone, with a reagent selected from the group consisting of alkaline earth metal hydrides, alkaline earth metal oxides and mixtures thereof, at elevated temperatures ranging from about 500° F to 2000° F, and wherein the hydrogen partial pressure is within the range of from about 500 to 5000 psig. The reaction product produced as a result of the above process comprises an alkaline earth metal sulfide phase and a desulfurized, upgraded petroleum oil having a sulfur and Conradson carbon content lower than that of the feedstock.

In one embodiment of the invention, the feedstock is contacted with barium oxide at a temperature and under a hydrogen partial pressure in the upper extremes of the temperature and hydrogen partial pressure ranges set out above to provide substantial desulfurization and demetallization while simultaneously hydroconverting heavy constituents of the feedstock to lighter, lower boiling components. Irrespective of the temperature and hydrogen pressure employed, barium sulfide is formed in the reaction zone and barium oxide may be regenerated therefrom as will be described below.

In another embodiment of the invention, the alkaline earth metal hydrides, and preferably barium hydride, are supplied as preformed reagents.

DETAILED DESCRIPTION OF THE INVENTION

The process of this invention is generally applicable to any sulfur-bearing feedstock. Thus, while the process is also applicable to lighter distillates, it is particularly effective when utilized to treat heavy hydrocarbons, e.g., those containing residual oils. Preferably, therefore, the process of the invention is utilized for the treatment of whole or topped crude oils and residua. Crude oils obtained from any area of the world such as the Middle East, e.g., Safaniya, Arabian heavy, Iranian light, Gach Saran, Kuwait, etc., the U.S. or Venezuelan, e.g., Laquinallas, Tia Juana, Bachaquero, etc., as well as heavy gas oils, shale oils, heavy catalyst cycle oils, tar sands or synthetic crudes derived from tar sands, coal oils, bitumen derived from tar sands, and asphaltenes, can be treated by the process of this invention. Additionally, both atmospheric residuum (boiling above about 650° F) and vacuum residuum (boiling above about 1050° F) can be treated. Preferably, the feedstock is a sulfur-bearing heavy petroleum oil having at least about 10 wt.% of materials boiling above about 1050° F and more preferably at least about 25 wt.% of materials boiling above about 1050° F. Where the feedstock is a whole crude it will generally contain between 1 and 3 wt.% sulfur therein, and when a residual feedstock, from between 2 and 7 wt.% sulfur therein, based upon the total feedstream.

The feedstock may be directly introduced into the reaction zone for combined desulfurization and hydroconversion, without pretreatment. It is desirable, however, to desalt the feedstock in order to prevent NaCl contamination of the alkaline earth metal products of the desulfurization reaction. Desalting is well known in the refining industry and may be effected by the addition of small amounts of water to the feedstock to dissolve the salt followed by the use of electrical coalescers. The oil is then dehydrated by conventional means.

The alkaline earth metal hydrides and alkaline earth metal oxides which may be employed for the process of the invention generally include the hydrides and oxides of the metals of Group IIA of the Periodic Table. Thus, hydrides and oxides of berylium, calcium, magnesium, strontium, and barium are suitable for use in the present process. The hydrides of barium and calcium are preferred due to their commercial availability as well as the ease with which they may be regenerated and recycled for further use. Furthermore, barium oxide is preferred over the other mentioned alkaline earth metal oxides inasmuch as it is substantially more effective as a desulfurizing and hydroconverting agent as compared to such other oxides.

The alkaline earth metal hydrides or oxides can be charged in a granular form ranging from powders (10+ microns) to particles (14 to 35 mesh range) or may be blended in a powder form with the feedstock prior to charging. Powders are preferred, however, in order to maximize reaction rate and minimize the need for mechanical agitation beyond the point of initial blending of powders and feedstock. The alkaline earth metal hydrides or oxides may also be employed as a dispersion in the feedstock itself prior to being charged into the reaction zone.

The amount of alkaline earth metal hydride or oxide employed may generally range from about 1 to about 40% by weight of the feedstock, and preferably from about 1 to about 25% by weight thereof, depending on the sulfur content of the feedstock. Thus, from about 0.1 to about 8.0 moles of alkaline earth metal hydride or oxide per mole sulfur in the feedstock can be employed, and preferably from about 0.5 to about 4, and more preferably from about 0.5 to about 2.0 moles of hydride or oxide per mole of feed sulfur.

In preferred embodiments of the process of the invention, barium oxide will be employed in an amount within the range of from about 12 to about 40% by weight of the feedstock; barium hydride will be employed in an amount within the range of from about 10 to about 35% by weight of the feedstock; and calcium hydride will be employed in an amount within the range of from about 3 to about 15% by weight of the feedstock. Barium hydride and/or barium oxide are particularly preferred reagents.

A hydrogen-containing gas is introduced into the reaction zone as either pure hydrogen (for example, from a steam reforming process) or as a diluted hydrogen gas stream (for example, that from refinery discard streams, e.g., subsequent to hydrotreating processes, gas effluent from cat cracker or reformer light ends streams, naphtha reformer recycle hydrogen streams, and the like).

Contact of the alkaline earth metal hydride and/or oxide reagent, hydrogen and the feedstock is carried out at reaction conditions designed to maintain the feedstock substantially in the liquid phase in the reaction zone and to effect simultaneous desulfurization and hydroconversion of the feedstock. Thus, the reaction of the feedstock, reagent and hydrogen may be carried out at a temperature within the range of from about 500° F to 2000° F and at a hydrogen partial pressure within the range of from about 500 to 5000 psig. The actual conditions of temperature and pressure maintained within the reaction zone are important depending upon whether only desulfurization is desired, or combined desulfurization and hydroconversion of the feedstock is required. Thus, in the preferred embodiment of the invention wherein it is desired to simultaneously effect desulfurization, demetallization and substantial hydroconversion of heavy constituents of the feedstock to lighter, lower boiling components, the feedstock, reagent, preferably barium oxide or barium hydride, and hydrogen are contacted at a temperature within the range of from about 700 to 1500° F, preferably within the range of from about 750 to 1000° F, and under a hydrogen partial pressure ranging from about 1500 to 3000 psig. Typical reaction holding times will range from about 15 minutes to 90 minutes and preferably about 60 minutes. Increasing the temperature and/or the hydrogen partial pressure results in increasing hydrogen consumption by the feedstock with concomitant increasing product quality, including increased demetallization, substantial desulfurization, a substantial reduction of Conradson carbon content and a substantial increase in API gravity.

It has been found that operating the reaction zone outside of these ranges does not yield the highly desirable simultaneous desulfurization and hydroconversion of the invention. In addition, in the absence of the hydrogen required in the reaction zone of this invention, severe cracking and coking of the feed occur where the oxide reagent is employed, whereas poor product quality is obtained where the hydride reagent is employed.

It will also be appreciated that the process of the invention may be operated in a staged manner by successive treatments of feed with fresh charges of the reagent and hydrogen.

The simultaneous desulfurization and hydroconversion can be conducted as a batch or continuous type operation. The apparatus used in carrying out the desulfurization and hydroconversion is of a conventional nature and can comprise a single reactor or multiple reactors equipped with shed rows or other stationary devices to encourage contacting; orifice mixers; efficient stirring devices such as mechanical agitators, jets of restricted internal diameter, turbomixers, and the like; or a packed bed, or other such means as described in U.S. Pat. No. 3,787,315 all of which is incorporated herein by reference thereto.

The feedstock and reagent can be passed through one or more reactors in concurrent, crosscurrent, or countercurrent flow, etc. It is preferable that oxygen and water be excluded from the reaction zones; therefore, the reaction system is normally purged with dry nitrogen and the feedstock dried prior to introduction into the reactor. It is understood that trace amounts of water, i.e., less than about 0.5 wt.%, preferably less than about 0.1 wt.% based on total feed, can be present in the reactor. The resulting oil dispersion is subsequently removed from the desulfurization zone and resolved by conventional means.

The salt produced in the above reaction generally comprises an alkaline earth metal sulfide in admixture with small amounts of coke and demetallization products. These salts are conveniently separated from the desulfurized feedstock by filtration, centrifugation, decantation, etc.

In accordance with the present invention the desired alkaline earth reagent, i.e., hydride or oxide, can be regenerated from the alkaline earth metal sulfides formed in the reaction zone by the well known, commercially practiced reactions shown below, and described for barium salts in Volumes 3 and 11 of the Encyclopedia of Chemical Technology, 2nd Edition, from Interscience Publishers, New York (1964).

STEP-A CONVERSION OF ALKALINE EARTH SULFIDES TO CARBONATES $$MS + CO_2 + H_2O \longrightarrow MCO_3 + H_2S$$

where M = Ba or Ca

STEP-B CONVERSION OF CARBONATES TO OXIDES $$MCO_3 + 2C \xrightarrow[> 1700° F]{} MO + 3CO$$

STEP-C CONVERSION OF OXIDE TO METAL $$4MO + 2Al \xrightarrow[\Delta]{} MO \cdot Al_2O_3 + 3M$$

STEP-D CONVERSION OF METAL TO HYDRIDE $$M + H_2 \xrightarrow[\sim 300° F]{} MH_2$$

Alternatively, the metal oxide may be converted to the metal hydride by reaction with phenol, followed by hydrogenation of the phenolate salt, as described in U.S. Pat. No. 2,392,545, which is also incorporated herein by reference thereto.

Barium and calcium hydrides may also be regenerated by reaction of the metal sulfides with hydrochloric acid to provide the metal chlorides and release hydrogen sulfide. The metal chlorides are subsequently reduced by hydrogen and ammonia, or by hydrogen and zinc, to provide the metal hydrides, as described in British Pat. No. 496,294.

The process if the invention will be more clearly understood by reference to the following examples. The feedstock used in all of the examples was a Safaniya atmospheric residuum with the following properties.

FEEDSTOCK INSPECTION

| Feed Designation | Safaniya |
|---|---|
| 1050-, Vol.% | 59 |
| API Gravity | 14.4 |
| Sulfur, Wt.% | 4.0 |
| Nitrogen, Wt.% | 0.26 |
| Carbon, Wt.% | 84.72 |
| Hydrogen, Wt.% | 11.14 |
| Oxygen, Wt.% | 0.26 |
| Conradson Carbon, Wt.% | 12.1 |
| Asphaltene, Wt.% | 14 |
| Metals, ppm | |
| Ni | 20 } 101 |
| V | 77 } 101 |
| Fe | 4 } 101 |
| Viscosity | |
| VSF 122° F | 235 |
| 144° F | 131 |
| Pour Point, ° F | 33 |
| Naphtha Insolubles, Wt.% | 7 |
| R.I. 67° C | — |
| Flash Point, ° F | 318 |

Alkaline earth metal hydride and oxide treated oil products were analyzed not only for sulfur content, but also for changes in metal content and general physical properties such as API gravity, and Conradson carbon.

EXAMPLES 1 to 3

The data shown below in Table I demonstrate the effect of hydrogen pressure on desulfurization and hydroconversion of the above feed with barium oxide.

TABLE I

THE EFFECT OF HYDROGEN PRESSURE AND OPERATING TEMPERATURE
(batch tests - treatment of Safaniya Atmospheric Residuum Feed)

| Example No. | 1 | 2 | 3 |
|---|---|---|---|
| Residuum, g. | 102.0 | 100.8 | 102.1 |
| Barium oxide, Wt.% feed | 19 | 19 | 19 |
| Hydrogen, psig | 500 | 1000 | 1700 |
| Temperature, ° F | 700 | 820 | 820 |
| Run Time, hr. | 1 | 1 | 1 |
| Residuum Product Analysis | | | |
| Sulfur, Wt.% | 3.2 | 2.0 | 2.2 |
| Metals | | | |
| Ni/V/Fe (ppm) | 21/44/3 | 1/16/3 | 9/1/2 |
| Coke, Wt.% | 0 | 6 | 1.1 |
| Conradson Carbon, Wt.% | 10.1 | 7.6 | 6.6 |
| API Gravity | 17.0 | 20 | 27 |
| Desulfurization, % | 18 | 50 | 45 |
| Demetallization, % | 32 | 80 | 88 |
| Conradson Carbon Removal,% | 17 | 38 | 46 |
| 1050-, Vol. % | — | — | 87 |
| Asphaltenes, Wt.% | — | 3.5 | 1.1 |

It is seen from the data of Table I that where increased hydrogen pressures and operating temperatures are employed, the hydroconversion activity increases as reflected by the greatly increased API gravity, decreased Conradson carbon and increased asphaltenes removal without coking, and by comparing the degree of 1050° F- content of the product of Example 3 as opposed to the products of Examples 1 and 2.

In addition, Example 1 shows the performance of barium oxide under desulfurization conditions. The data of Example 2 show that where hydroconversion temperatures are employed (above 800° F) with too low a hydrogen pressure (below 1200 psig) a high coke yield results.

EXAMPLES 4 to 8

The data shown below in Table II demonstrate the effectiveness of barium hydride used in conjunction with hydrogen on desulfurization and hydroconversion.

TABLE II

THE EFFECT OF TREATMENT OF SAFANIYA ATMOSPHERIC RESIDUUM WITH BARIUM HYDRIDE

| Example No. | 4 | 5 | 6 | 7 | 8 |
|---|---|---|---|---|---|
| Reactants | | | | | |
| Residuum,g. | 92.3 | 96.0 | 101.5 | 104.3 | 100.1 |
| Barium hydride, Wt.% feed | 17 | 7 | 17.4 | 17 | 3 |
| Hydrogen, psig | 200 | 330 | 500 | 1700 | 1700 |
| Reaction Period, hr. | 2 | 2 | 1 | 1 | 1 |
| Temperature, ° F | 700 | 750 | 700 | 820 | 820 |
| Residuum Product Analysis | | | | | |
| Sulfur,Wt.% | 2.1 | 1.6 | 1.90 | 1.2 | 2.4 |
| Metals Ni/V/Fe (ppm) | 24/84/13 | 14/93/2 | 18/79/4 | 8/3/0 | 3/5/0 |
| Coke,Wt.% | 0.2 | 1.6 | 0 | 0.6 | 3.4 |
| Conradson Carbon, Wt.% | 10.5 | 8.8 | 8.9 | 6.1 | 7.0 |
| Desulfurization, % | 47.5 | 60 | 53.1 | 70 | 39 |
| Demetallization, % | 13 | 27 | 26.4 | 90 | 92 |
| Conradson Carbon Removal,% | 13 | 27 | 26.4 | 54 | 42 |
| API Gravity | 18.0 | 19.6 | 18.6 | 28.8 | 28.3 |
| Vol. % 1050- | — | — | — | 85 | — |

As seen in Table II, barium hydride (employed with hydrogen) is an effective desulfurizing agent and hydroconverting agent, as indicated by the percent desulfurization, as well as the increased API gravity over the feedstock, and the Conradson carbon removal.

EXAMPLES 9 to 11

The data shown below in Table III demonstrates the effectiveness of calcium hydride and oxide, used in conjunction with hydrogen, an desulfurization and hydroconversion. These data also indicate that calcium hydride and oxide are effective as reagents for desulfurizing and hydroconverting oil feedstock in the presence of added hydrogen. However, in comparing the data of Table III with that of Table II, it is seen that barium hydride and oxide are substantially more effective for such purposes than are calcium hydride and oxide.

TABLE III

THE EFFECT OF TREATMENT OF SAFANIYA ATMOSPHERIC RESIDUUM WITH CALCIUM HYDRIDE AND OXIDE

| Example No. | 9 | 10 | 11 |
|---|---|---|---|
| Reactants | | | |
| Residuum,g. | 101.8 | 100.8 | 100.2 |
| Calcium hydride, Wt.% feed | 5.6 | 5.3 | — |
| Calcium oxide, Wt.% feed | — | — | 7.0 |
| Hydrogen, psig | 200 | 1700 | 1700 |
| Reaction Period, hr. | 2 | 1 | 1 |
| Temperature, ° F | 700 | 820 | 820 |
| Residuum Product Analysis | | | |
| Sulfur,Wt.% | 3.7 | 3.4 | 2.5 |
| Metals Ni/V/Fe (ppm) | 20/76/6 | 3/14/0 | 3/14/0 |
| Coke,Wt.% feed | 0.1 | 7.1 | 5.2 |
| Conradson Carbon, Wt.% | 11.4 | 10.0 | 7.2 |
| Desulfurization, % | 7.5 | 13 | 36 |
| Demetallization, % | 0 | 83 | 83 |
| Conradson Carbon Removal, % | 5.7 | 41 | 41 |
| API Gravity | 15.8 | 29.5 | 29.7 |

What is claimed is:

1. A process for simultaneously desulfurizing and hydroconverting a heavy, sulfur-containing hydrocarbon feedstock which comprises contacting said feedstock and hydrogen in a reaction zone, said feedstock being substantially in the liquid phase in said reaction zone, with a reagent selected from the group consisting of alkaline earth metal hydrides, oxides and mixtures thereof at a temperature within the range of from about 700° to about 1500° F and a hydrogen partial pressure ranging from about 1500 to 3000 psig to form an oil product having a reduced sulfur and Conradson carbon content and an alkaline earth metal sulfide phase.

2. The process of claim 1 wherein said reagent is selected from the group consisting of hydrides and oxides of calcium and barium.

3. The process of claim 2 wherein the reaction zone is maintained at a temperature within the range of from about 750° to about 1000° F.

4. The process of claim 3 wherein said reagent consists essentially of calcium hydride.

5. The process of claim 3 wherein said reagent consists essentially of barium hydride.

6. The process of claim 1 wherein said alkaline earth metal hydride is present in a mole ratio to moles of sulfur present in said feedstock of within the range of from about 0.5 to about 4.0.

7. The process of claim 3 wherein said reagent consists essentially of barium oxide.

8. The process of claim 7 wherein the molar ratio of said barium oxide to the sulfur content of said feedstock is within the range of from about 0.5 to about 2.0 moles per mole of sulfur.

9. The process of claim 1 including the steps of converting said alkaline earth metal sulfide to an alkaline earth metal oxide, and recycling the so-regenerated alkaline earth metal oxide for further treatment of feedstock.

10. The process of claim 1 wherein said reagent is present in an amount within the range of from about 1 to about 40% based on the weight of said feedstock.

11. The process of claim 1 wherein said feedstock is selected from the group consisting of whole or topped crude oils and residua.

12. The process for simultaneously desulfurizing and hydroconverting a sulfur-containing heavy petroleum oil feedstock having at least 10 wt.% of materials boiling above about 1050° F which comprises contacting said feedstock and hydrogen in a reaction zone, said feedstock being substantially in the liquid phase in said reaction zone, with a reagent selected from the group consisting of alkaline earth metal hydrides, oxides and mixtures thereof at a hydrogen partial pressure ranging from about 1500 to 3000 psig and at elevated temperatures ranging from about 700° to 1500° F to form an oil product having a sulfur and Conradson carbon content lower than that of the feedstock and an alkaline earth metal phase.

13. The process of claim 12 wherein said reagent is selected from the group consisting of hydrides and oxides of barium and calcium.

14. The process of claim 13 wherein the feedstock is selected from the group consisting of whole crude oils, topped crude oils and residua.

15. The process of claim 14 wherein the reaction zone is maintained at a temperature within the range of from about 750° to about 1000° F.

* * * * *